US005230405A

United States Patent [19]

Bartelt

[11] Patent Number: 5,230,405

[45] Date of Patent: Jul. 27, 1993

[54] STAIRWAY CHAIRLIFT DEVICE

[75] Inventor: Robert D. Bartelt, Merton, Wis.

[73] Assignee: Michael Roman Bruno, Oconomowoc, Wis.

[21] Appl. No.: 792,132

[22] Filed: Nov. 13, 1991

[51] Int. Cl.[5] ..... B66B 9/08; B66B 11/04

[52] U.S. Cl. ..... 187/12; 187/19

[58] Field of Search ..... 187/12, 19

[56] References Cited

U.S. PATENT DOCUMENTS

| | | | |
|---|---|---|---|
| 56,947 | 8/1866 | Jenks | 187/12 |
| 2,507,887 | 5/1950 | Cheney | 187/12 |
| 3,966,022 | 6/1976 | Cheney | 187/19 X |
| 4,913,264 | 4/1990 | Voves et al. | 187/12 |
| 5,105,914 | 4/1992 | Holden | 187/12 |

FOREIGN PATENT DOCUMENTS

| | | |
|---|---|---|
| 3001298 | 1/1980 | Fed. Rep. of Germany . |
| 2901422 | 7/1980 | Fed. Rep. of Germany . |
| 2137589 | 10/1984 | United Kingdom . |
| 2157653 | 10/1985 | United Kingdom . |
| 2184707 | 7/1987 | United Kingdom . |

*Primary Examiner*—Robert P. Olszewski
*Assistant Examiner*—Dean A. Reichard
*Attorney, Agent, or Firm*—Whyte & Hirschboeck

[57] ABSTRACT

A stairway chairlift device has a rail incorporating a gear rack, a carriage unit having a motor and gear box which operatively engage the gear rack to provide motion of the chairlift, and a collapsible seat assembly mounted to the carriage unit. The carriage unit also incorporates a battery unit and control circuitry to control operation of the chairlift. The electrical system also incorporates an automatic recharging circuit any time the chairlift is at the bottom or top of the rail. The seat assembly is easily pivoted on a swivel mechanism which permits the seat assembly to be locked in one of three positions—right 90°, front or left 90°.

17 Claims, 8 Drawing Sheets

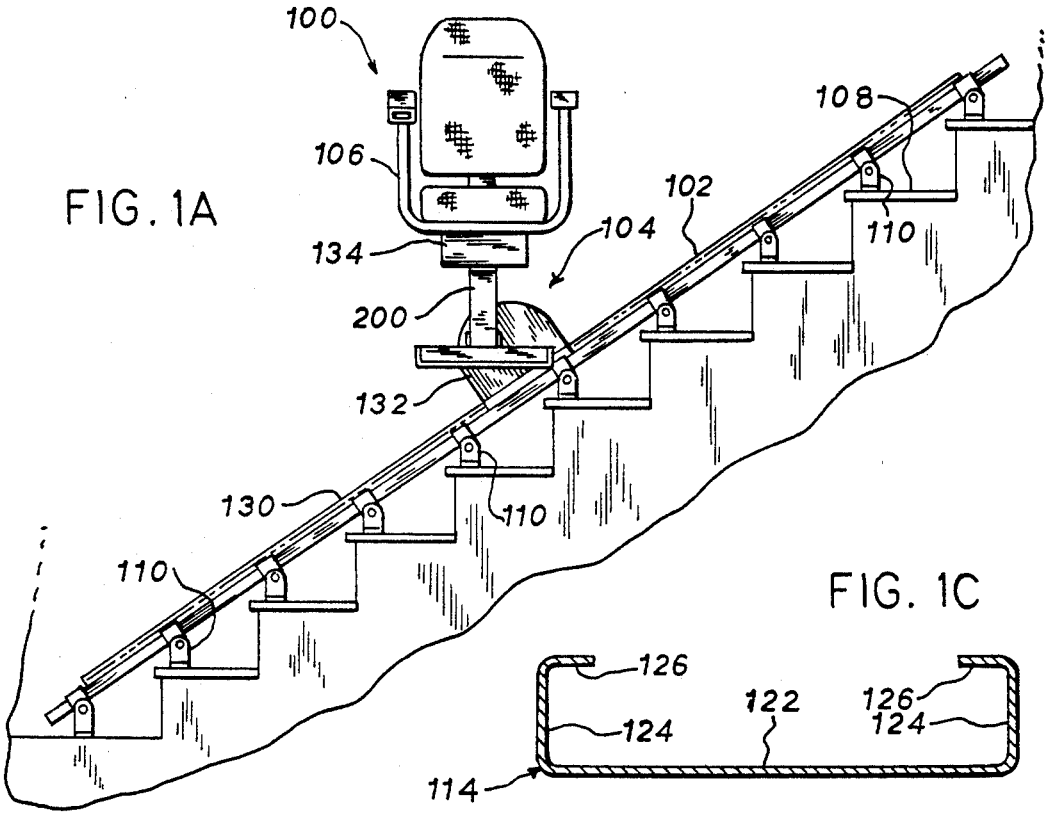
FIG. 1A
FIG. 1C
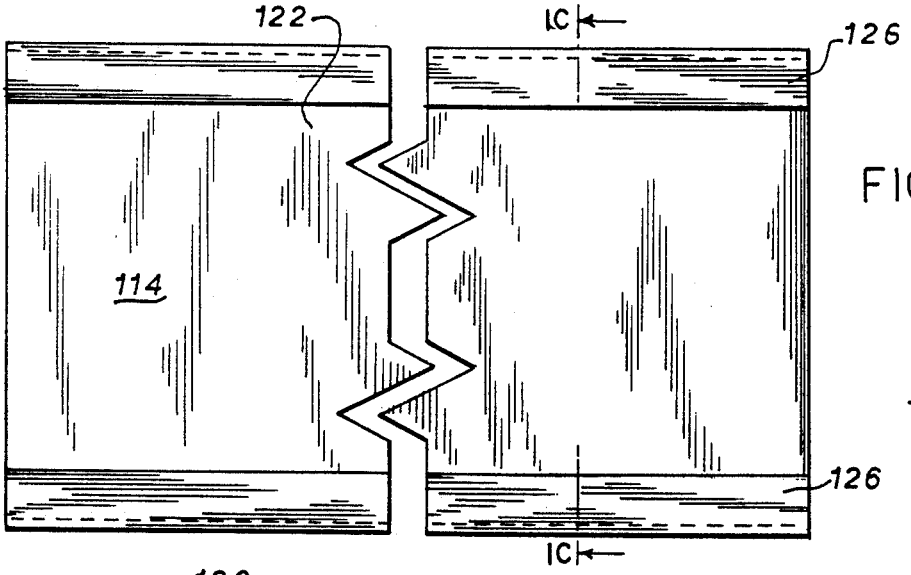
FIG. 1B
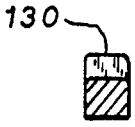
FIG. 1E
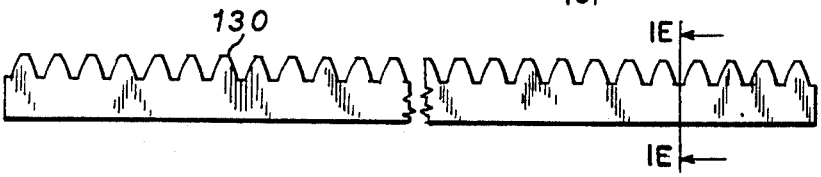
FIG. 1D 254
238
242
220
214
218
204
200
228
224
222
210
226
232
140
230
206
142
138
144
3B
254
236
242
244
156
136
212
212
240
240
238
238
200
218
218
216
204
214
222
206
234
208
230
142

150
150
148
148
144
146
146
3B 270
278
278
276
280

260
258
106
262
284
268
264
266
254
286
248
248
236
256
246
244

4A
264
248
260
268
262
248
284
282
246
282
282
248
266
4A

FIG. 5
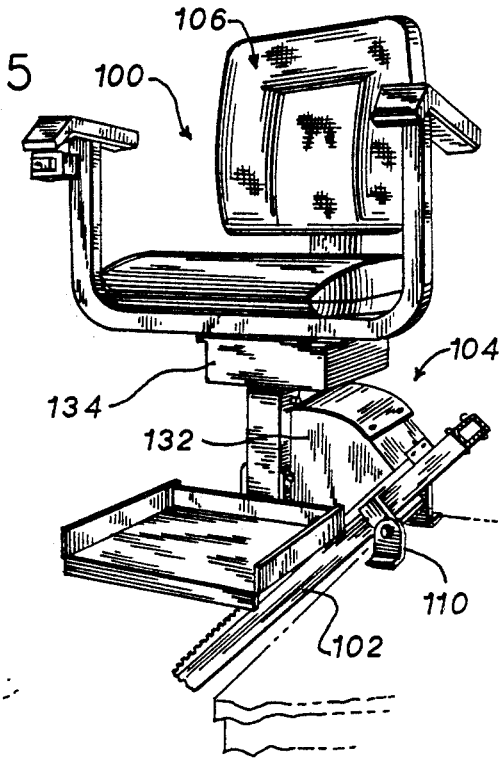
FIG. 6
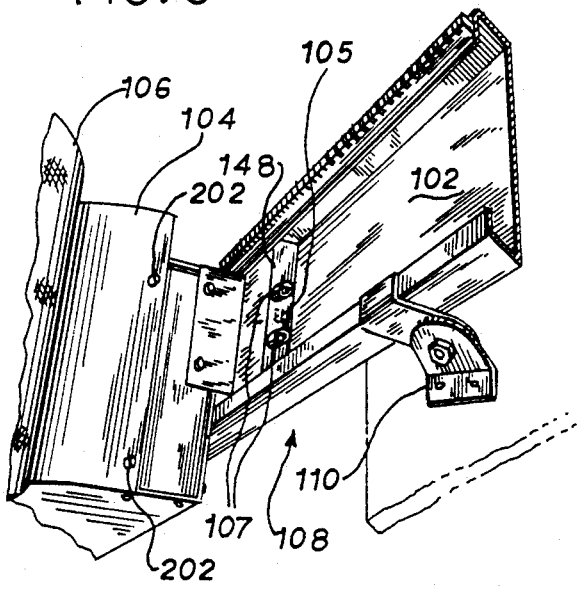
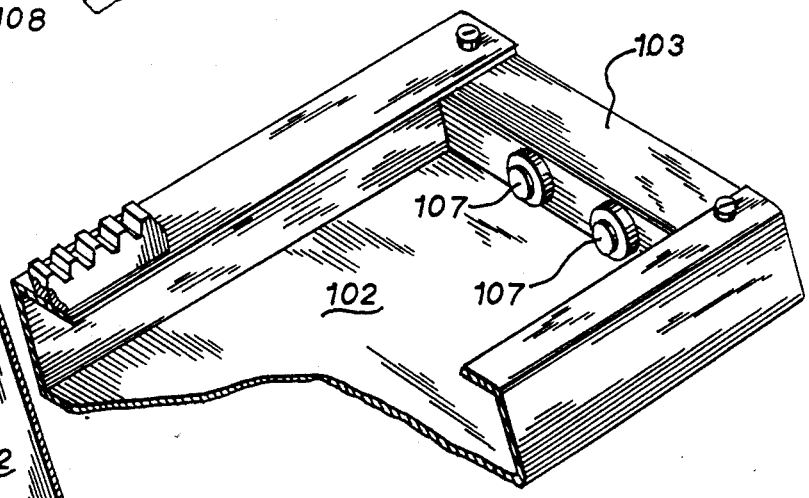
FIG. 7
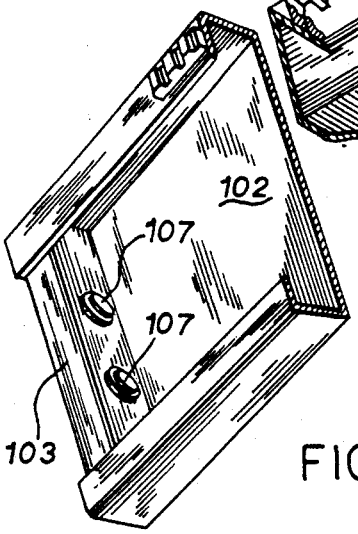
FIG. 8

STAIRWAY CHAIRLIFT DEVICE

Cross-References to Related Applications, If Any: None.

Statement as to rights to inventions made under Federally-sponsored research and development, if any: None.

BACKGROUND OF THE INVENTION

1. Field of the Invention

The present invention relates generally to stairway chairlift devices for individually transporting passengers in ascending and descending directions along a stairway or other inclined surface. More particularly, the present invention relates to a self-contained, battery-operated stairway chairlift device which has a pivotable, collapsible seat assembly which may be adjusted for angular settings relative to the stairway.

2. Description of Related Art

Stairway chairlift devices have been in existence since approximately 1939. During this 52 year period, a number of devices have been developed for individually transporting persons who have difficulty in ascending and descending stairs and other inclined surfaces. Earlier systems have used electrical power from a building, requiring wires and/or cords to and from the device for operation. A number of systems have been developed for letting electrical cord out and gathering electrical cord in (a "following cord") as the passenger seat moves along the stairway. These following cords cause difficulty and wear and tear on systems through their constant bending. In addition, the incremental cost of adding devices to accomodate following electrical cords significantly increases the cost of a chairlift device for a purchaser.

Devices have also been developed for increasing the ease with which passengers may move onto and off of the seating assembly of chairlift devices. One example of such a device is shown in U.S. Pat. No. 4,913,264 issued on Apr. 3, 1990 to Voves, et al. for a STAIRWAY CHAIRLIFT MECHANISM. The '264 patent shows a stairway chairlift mechanism having a seat assembly which uses a number of runners and guides to allow rotation of the seat without interference from a wall or other obstruction behind the seating assembly.

A chairlift device which overcomes the shortcomings, limitations and restrictions of prior devices would be a significant advancement in the art.

DETAILED DESCRIPTION OF THE DRAWINGS

FIG. 1A is a front perspective view of the present invention.

FIG. 1B is a top perspective view of the rail insert of the present invention.

FIG. 1C is a cross-sectional view of the rail insert of the present invention.

FIG. 1D is a side view of the gear rack of the present invention.

FIG. 1E is an end view of the gear rack of the present invention.

FIG. 5 is a front perspective view of the present invention.

FIG. 6 is a perspective view of the rail and carriage of the present invention, showing in particular the limit switch and recharging contacts of the carriage unit.

FIG. 7 is a perspective view of the recharging contacts of the present invention mounted at the top of the rail.

FIG. 8 is a perspective view of the recharging contacts mounted at the bottom of the rail of the present invention.

In the FIGURES, like reference numerals refer to like components.

OBJECTS AND SUMMARY OF THE INVENTION

Figure 2A:
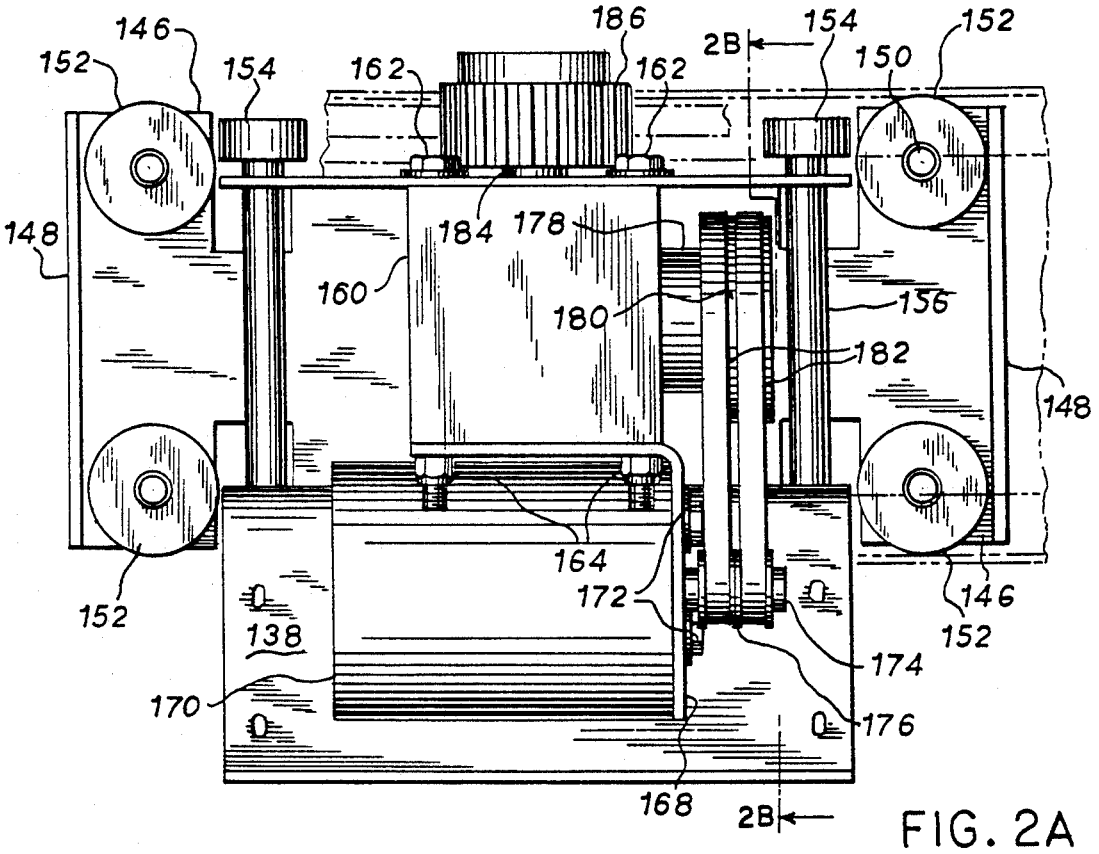
FIG. 2A is a top cross-sectional area of the motor housing of the present invention.
Figure 2B:
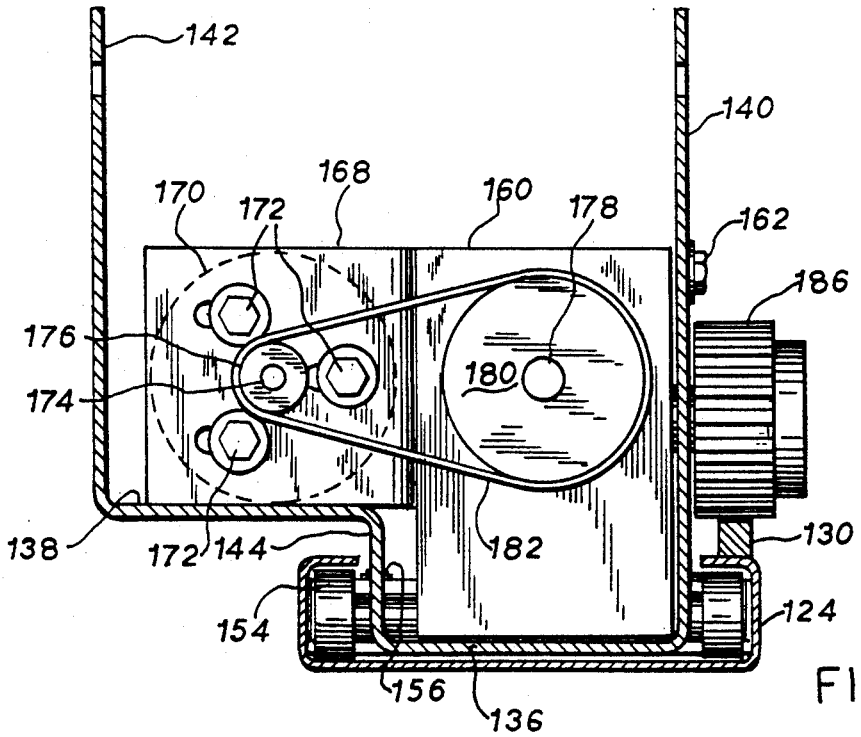
FIG. 2B is a side cross-sectional view of the motor housing of the present invention.
Figures 3A, 3B:
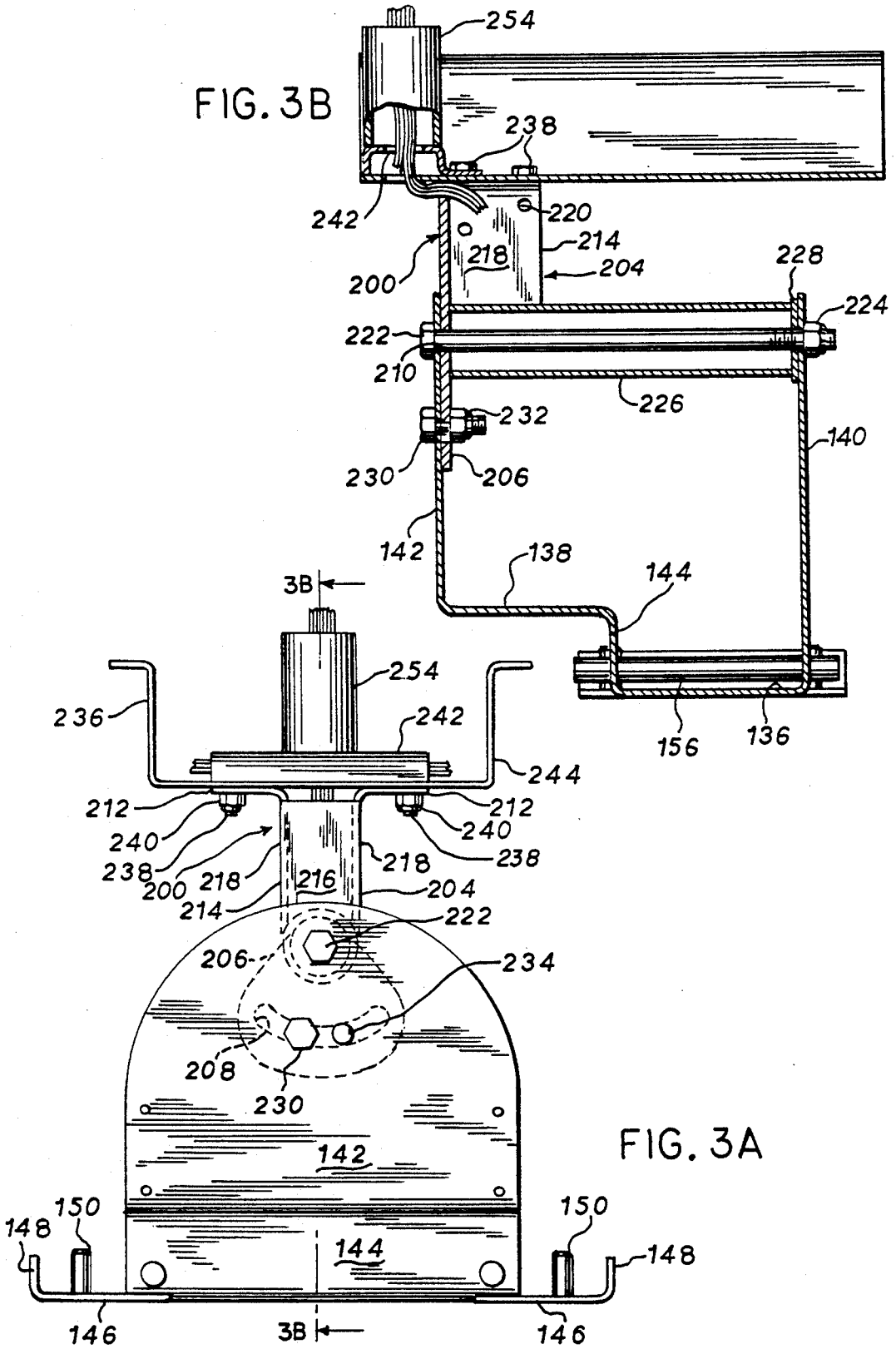
FIG. 3A is a front view of the carriage unit of the present invention.
FIG. 3B is a side cross-sectional view of the carriage unit of the present invention.

It is an object of the present invention to provide a stairway chairlift device which is usable on any inclined base and can be easily adjusted for the angular orientation of that surface. It is another object of the present invention to provide a stairway chairlift device which is battery operated and does not require the use of a following electrical cord.

It is yet another object of the present invention to provide a stairway chairlift device which is less expensive to produce than prior devices to produce.

It is a different object of the present invention to provide a stairway chairlift device utilizing a pivoting seat assembly which is of simpler construction and more easily operated than prior devices and is less expensive to produce.

It is yet a different object of the present invention to provide a stairway chairlift device which is battery-operated and automatically self-recharging.

It is still another object of the present invention to provide a stairway chairlift device which incorporates a collapsible seat assembly to provide additional space on the stairway or other inclined surface where the device is installed when the chairlift is not in use.

How these and further objects of the present invention are accomplished will be described by reference to the following description of the invention taken in conjunction with the FIGURES. Generally, however, the objects are accomplished in a stairway chairlift device having a rail incorporating a gear rack, a carriage unit having a motor and gear box which operatively engage the gear rack to provide motion of the chairlift, and a collapsible seat assembly mounted to the carriage unit. The carriage unit also houses a pair of batteries and control circuitry to control operation of the chairlift. The electrical system also incorporates an automatic recharging circuit which recharges the batteries any time the chairlift is at the bottom or top of the rail. The seat assembly is easily pivoted on a swivel mechanism which permits the seat assembly to be locked in one of three positions—right 90°, front, or left 90°.

DESCRIPTION OF THE PREFERRED EMBODIMENT

The preferred embodiment of the present invention is shown in FIG. 1A. A stairway chairlift 100 has a rail assembly 102, a carriage with 104, and a seat assembly 106. Rail assembly 102 is shown mounted to a stairway 108 using a series of brackets 110.

Rail Assembly

Rail assembly 102 consists of a rail 114 made of steel. Rail 114 provides guide and stabilizing surfaces for the carriage unit 104. Rail 114 has a generally planar base surface 122 with vertical guides 124 extending upward therefrom. Each vertical guide 124 has a retaining surface 126 extending inwardly. Rail 114 thus has a C-shaped cross-section as seen in FIG. 1C.

Rail 114 also has a gear rack 130 welded to it. The gear rack 130 may be located on either side of the rail assembly 102, depending upon the desired orientation of the chairlift seat assembly 106 relative to the stairway or other inclined mounting base. In the preferred embodiment, the gear rack is 8 pitch and has a 20° pressure angle.

Carriage

The carriage unit 104 has a lower motor housing 132 and an upper control housing 134. The motor housing 132 has a first lower base surface 136 and a second, slightly elevated base surface 138. A rear vertical surface 140 extends vertically upward from surface 136. A front vertical surface 142 extends from surface 138. An intermediate vertical surface 144 connects surfaces 136 and 138. In the preferred embodiment, surfaces 136, 138, 140, 142, 144 are part of a unitary carriage frame made of 7 guage sheet steel.

A number of stabilizing wheels are used in connection with the preferred embodiment of the carriage 104. As seen in FIG. 2A, the base 136 of the carriage has two extensions 146, each of which has a vertical guide 148. A number of stablizer wheel shafts 150 are welded to extensions 146. Each shaft 150 holds a stabilizer wheel 152 which is free to rotate and engages one of the vertical guides 124 of the rail 114. Stabilizer wheels 152 are retained on shafts 150 by conventional means such as push nuts (not shown in detail).

Stabilization along another axis is accomplished by another series of stabilizing wheels 154. A pair of axles 156 extend through and are perpendicular to intermediate surface 144 and vertical surface 140. Axles 156 are slightly bent to ensure that the stabilizer wheels 154 properly engage the rail 114 and to ensure that spur gear 186 properly and securely engages the gear rack 130. Stabilizer wheels 154 are rotatably secured to the ends of each axle 156. Wheels 154 are mounted by conventional means (not shown in detail). Wheels 154 engage base surface 122 and retaining surfaces 126 of the rail 114. In the preferred embodiment, axles 156 ensure that the wheels 154 immediately adjacent surface 144 engage base surface 122 while the wheels 154 immediately adjacent surface 140 engage only the retaining surface 126.

The motive system of the present invention is housed in the carriage unit 104. A gear box 160 is mounted to rear wall 140 with a series of bolts 162 and nuts 164. A back plate 166 is also held in place by bolts 162 and will be explained in more detail below. Gear box 160 houses a gear mechanism that is not shown in detail. The operation of the gearing mechanism will be explained in more detail below and is a matter of design choice depending upon the desired operating characteristics of the chairlift.

An L-shaped bracket 168 is also fixedly secured to the gear box 160 by bolts 162 and nuts 164. A motor 170 is likewise secured to the bracket 168 with a number of threaded bolts 172. The motor 170 is of conventional design and its operating specifications are a matter of design choice. Motor 170 has an input shaft 174 to which is mounted a pair of belt drive wheels 176. Similarly, gear box 160 has an output shaft 178 to which is mounted a pair of belt drive wheels 180. Belts 182 engage both sets of wheels 176, 180.

Figure 17:
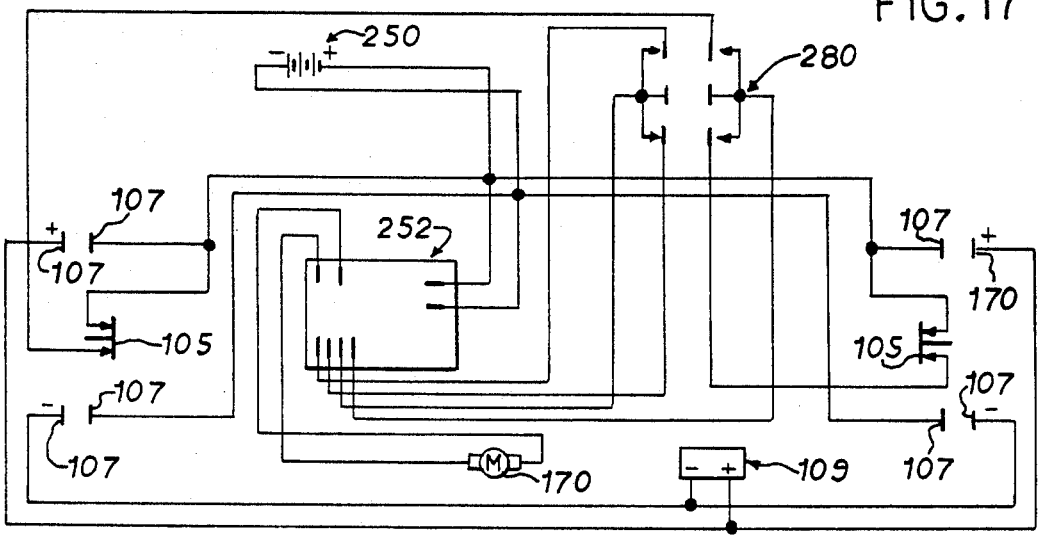
FIG. 17 is a schematic drawing of the electrical system of the present invention.
Figure 12:
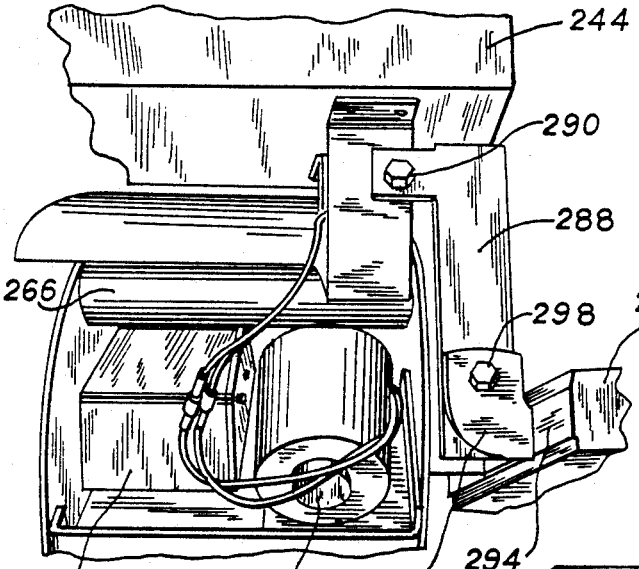
FIG. 12 is a perspective view of the inside of the motor housing of the present invention.
Figure 13:
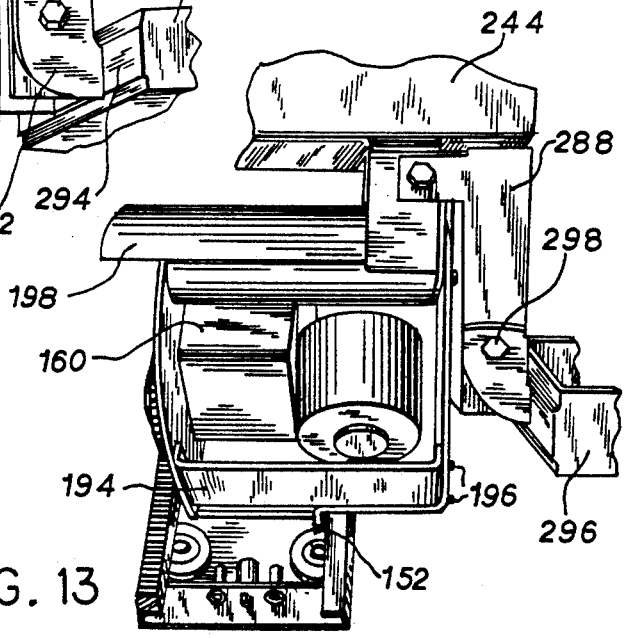
FIG. 13 is a side perspective view of the inside of the motor housing of the present invention.
Figure 14:
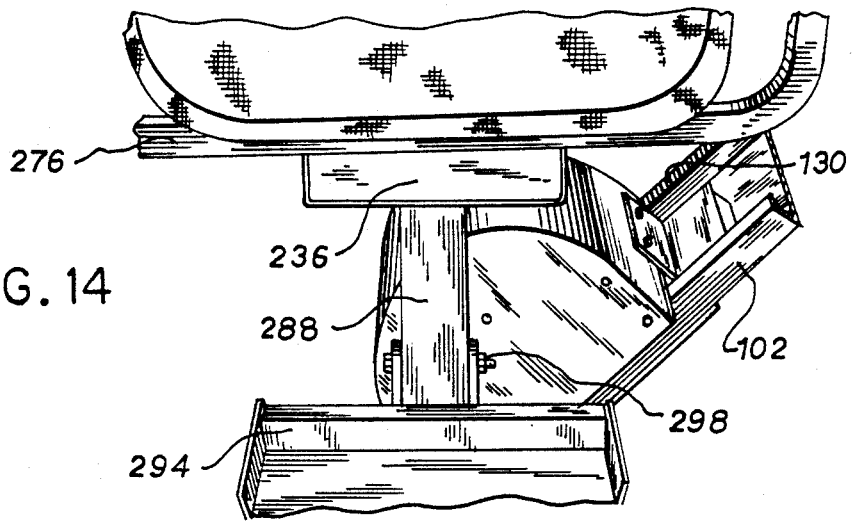
FIG. 14 is a close-up perspective of the foot rest mounting and motor housing of the present invention.
Figure 15:
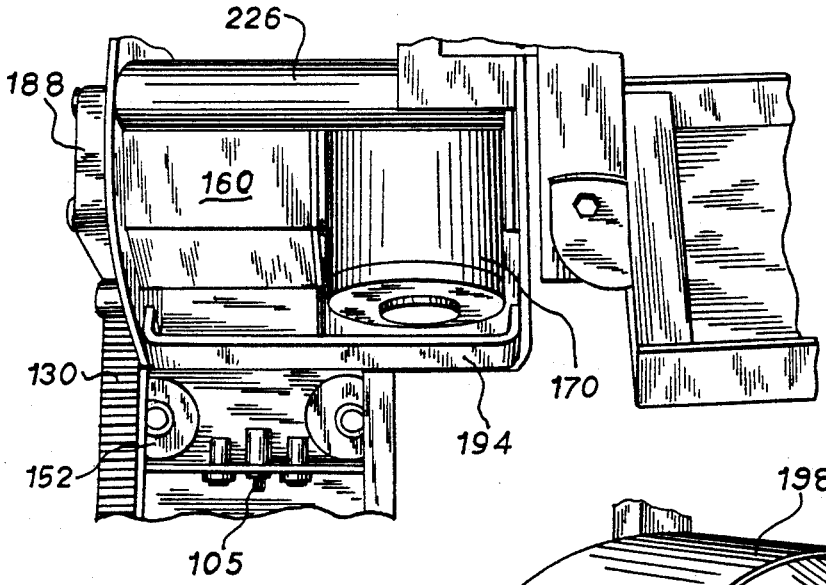
FIG. 15 is a close-up view of the inside of the motor housing of the present invention.
Figure 16:
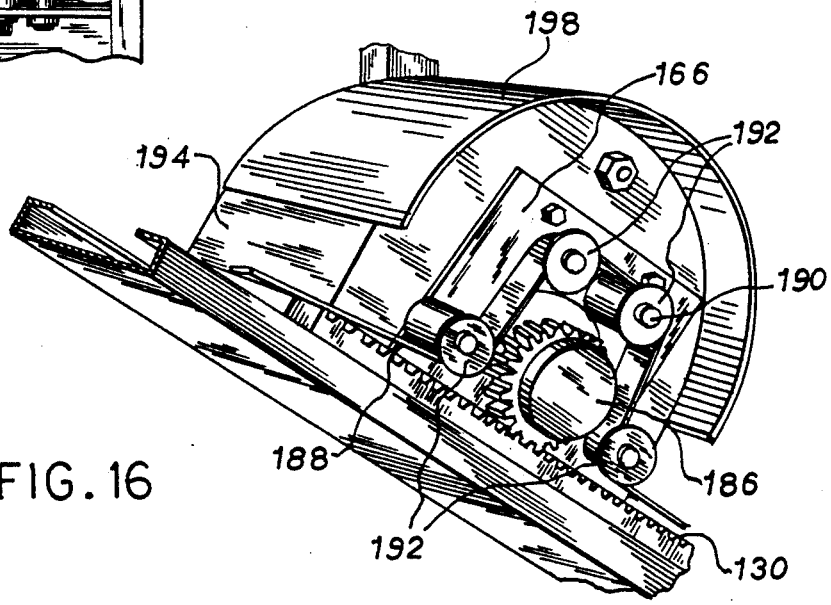
FIG. 16 is a perspective of the rear face of the motor housing of the present invention.

The output shaft 184 of the gear box 160 extends through surface 140 and back plate 166 and has a spur gear 186 mounted thereto. Spur gear 186 engages the gear rack 130. A nylon tape 188 is secured at each end of the rail 102. Back plate 166 has four tape guide pins 190 welded thereto. Each guide pin 190 has a tape guide 192 which engages the tape 188 to provide a partial cover for the spur gear 186 and gear rack 130. As seen in FIG. 17, the tape 188 is maintained in a covering position throughout movement of the carriage 104.

The motor 170 and gear box 160 are enclosed by a multi-part carriage housing in the preferred embodiment. Adjacent each extension 146 is a reinforcement plate 194. Each plate 194 is secured to surfaces 136, 140, 142 by a number of screws 196. An arcuate housing cover 198 is secured to each reinforcement plate 194. Covers 198 overlap slightly to provide coverage of the motor 170 and gear box 160. A small opening is provided between the front edges of covers 198 to permit mounting assembly 200 to extend upwardly from the motor housing. Covers 198 are attached to reinforcement plates 194 by screws 202. The rear edge of each cover 198 extends beyond surface 140 to assist in covering the spur gear 186 and the tape guides 192.

Mounting assembly 200 includes an angle adjustment arm 204 made of steel in the preferred embodiment. Arm 204 has a lower slotted tongue 206 which includes an arcuate adjustment slot 208 and a pivot hole 210. Two generally horizontal flanges 212 are provided at the top of the arm 204. Flanges 212 and tongue 206 are connected by an intermediate brace 214. Brace 214 has a front face 216 and two side faces 218 which are perpendicular to face 216. Side faces 218 are provided with holes 220 which will be explained in greater detail below. In the preferred embodiment, arm 204 (that is, tongue 206, flanges 212 and brace 214) is one piece of formed steel.

Arm 204 is secured to surfaces 140, 142 by a bolt 222 and nut 224. A torsion tube 226 is welded to the back face of tongue 206 and has an end cap 228 welded to its rearward end. End cap 228 frictionally engages the inside surface of wall 142. Tongue 206 is further secured with a bolt 230 which passes through slot 208 and wall 142 and is held by a nut 232. In the preferred embodiment, a pair of holes 234 are provided in wall 142 to increase the angular adjustability of arm 204.

A control box 236 is fixedly mounted to the top of arm 204. More specifically, box 236 is bolted to flanges 212 with bolts 238 and nuts 240. The front pair of bolts 238 also secures a mounting bracket 242, which will be explained in more detail below. Box 236 has a shell 244 and a cover 246, both of which are made of sheet steel in the preferred embodiment. Shell 244 and cover 246 are secured to one another by a number of screws 248.

A pair of batteries 250 are housed in box 236. Batteries 250 supply power to run the motor 170. Batteries 250 are connected to a control circuit 252 which is not shown in detail. Circuit 252 is of conventional design and performs several specific functions. Circuit 252 provides the signal to motor 170 to move the carriage unit 204 in the desired direction. Other functions which may be performed by circuit 252 are a matter of design choice.

Figures 4A, 4B, 4C:
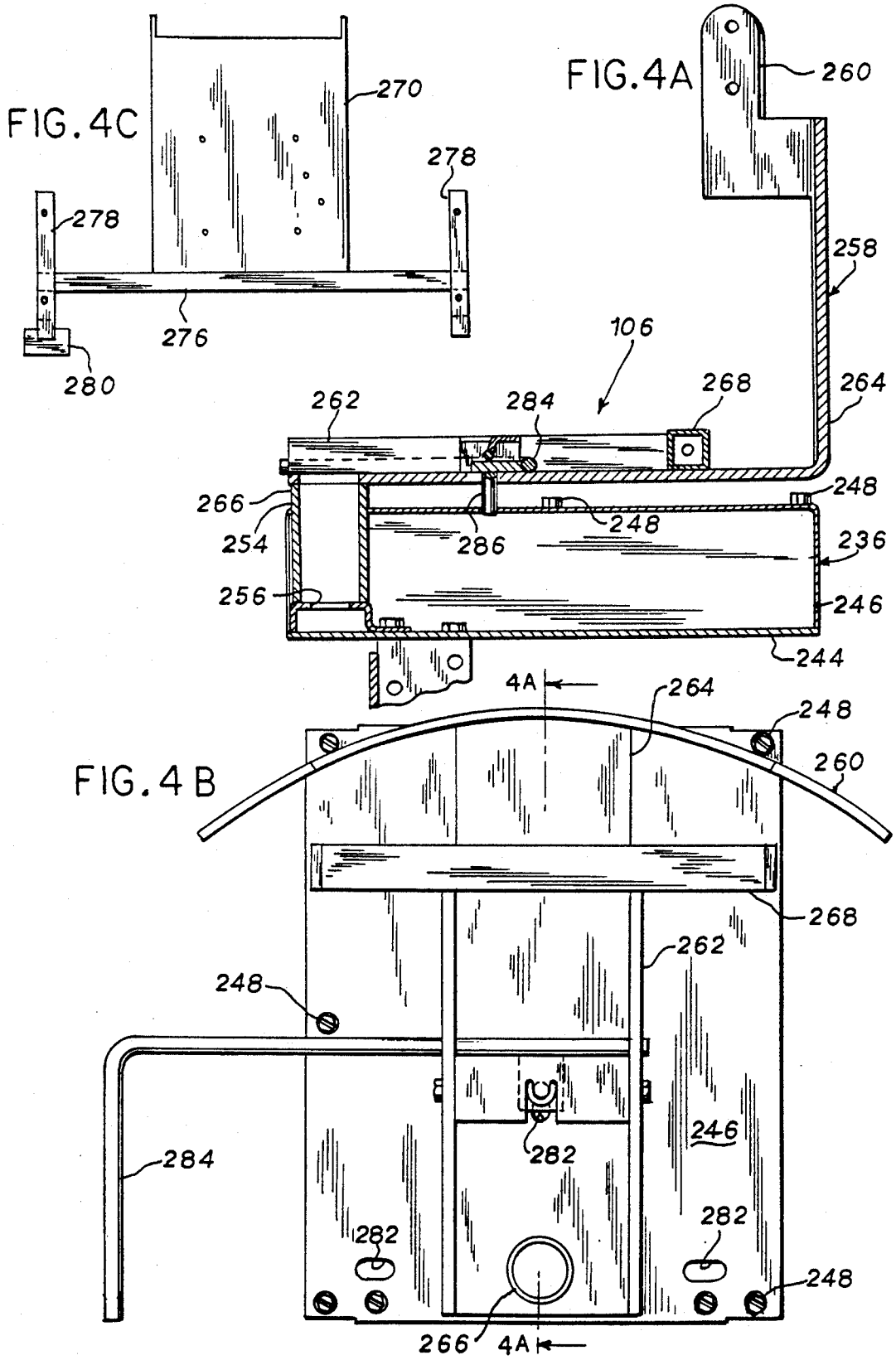
FIG. 4A is a side cross-sectional view of the carriage unit and seat assembly of the present invention.
FIG. 4B is a top view of the swivel mechanism of the present invention.
FIG. 4C is the seat frame of the present invention.
Figure 9:
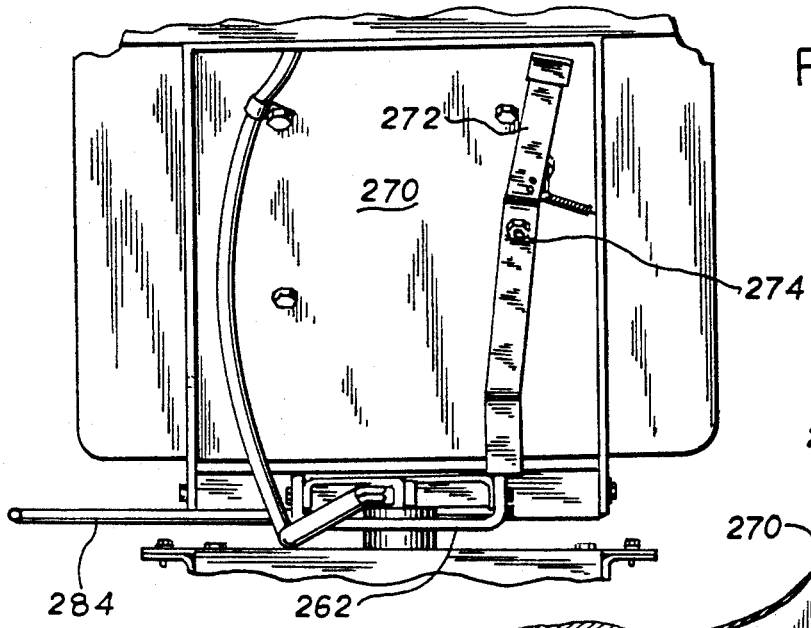
FIG. 9 is a perspective view of the underside of the seat assembly of the present invention.

Bracket 242 provides the base for a swivel housing 254. Housing 254 is a piece of steel tubing welded to bracket 242. As shown in FIG. 4A, housing 254 extends upwardly through cover 246. A hole 256 is provided in bracket 242 to permit wires from control circuit 252 to pass through to the seat assembly 106.

Each end of the rail 102 has a bumper 103. Each bumper 103 serves two functions. A limit switch 105 is positioned on each guide 148. When limit switch 105 touches a bumper 103 or other obstruction, motor 170 is prevented from moving the chairlift further in that direction. Each bumper 103 and guide 148 is also provided with matching pairs of recharging contacts 107. As seen in FIG. 49, a battery recharger 109 is provided to recharge the batteries 250 whenever the carriage 104 is at the top or bottom of the rail 102. The battery recharger is of conventional design. The use of a recharger in the present invention, however, is novel and nonobvious. As a further feature of recharging, the recharger 109 only operates until the batteries 250 are fully recharged. Once that is accomplished, the recharger 109 switches off.

Seat Assembly

The seat assembly 106 is mounted to the carriage unit 104 by using the swivel housing 254. Seat assembly 106 includes a seat frame 258. Frame 258 is unitary and has an arcuate back support 260, a seat support bracket 262, and a brace 264 connecting bracket 262 and support 260. A swivel tube 266 is welded to the underside of bracket 262. Tube 266 fits coaxially into housing 254 to permit rotation of seat assembly 106. A bearing made of low friction material may be used to reduce wear and friction during rotation of tube 266 within housing 254.

Figure 10:
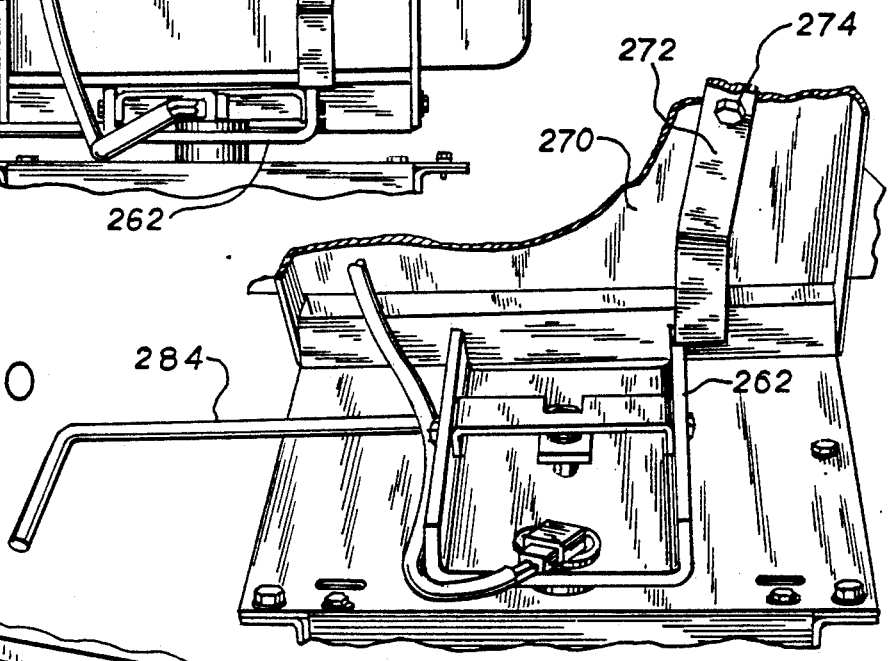
FIG. 10 is a perspective view of the swivel and seat assembly of the present invention.
Figure 11:
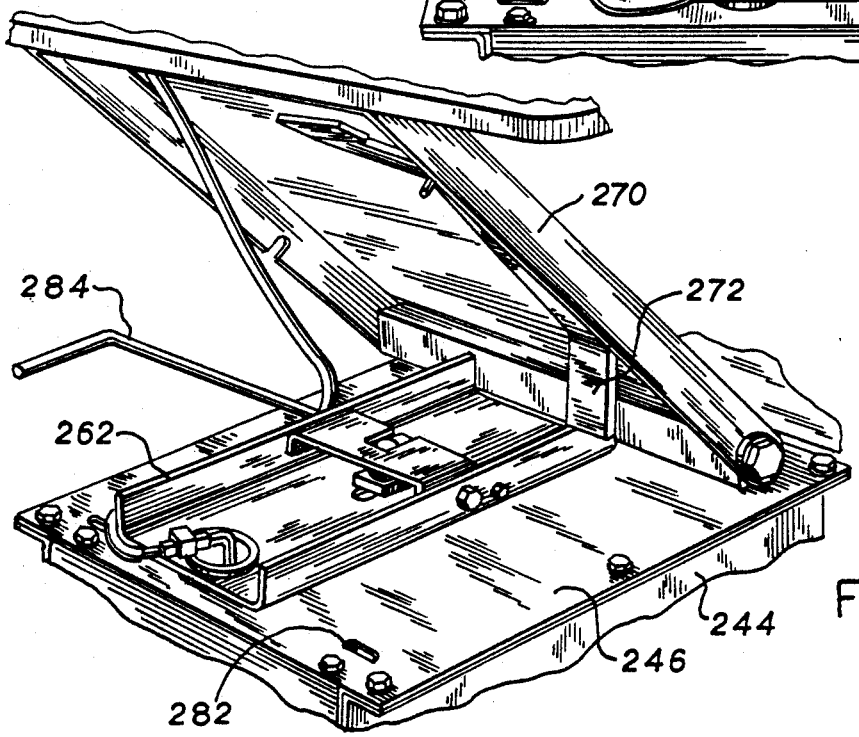
FIG. 11 is a side perspective view of the swivel and seat assembly of the present invention.

A mounting tube 268 is also welded to the frame 258. Tube 268 is mounted at the juncture of brace 264 and seat bracket 262. A seat frame 270 is pivotably mounted to tube 268, permitting frame 270 to be lifted into a nearly veritical, or "up" position when desired. A seat hold up bar 272 is secured to the underside of frame 270 by a screw 274. Bar 272 may be moved into a locking position in which it engages seat bracket 262, as shown in FIG. 10, to maintain the seat in an up position when desired. As will be explained in more detail below, the seat is still pivotable in this position. Bar 272 may be spring loaded so as to maintain the bar in a nonlocking position when desired.

Welded to seat frame 270 is an arm rest support 276. Arm rest 276 provides mounting points for arm rests 278. The arm rests 278 ar of conventional design and will not be described in detail. Mounted to one of the arm rests is a switch 280 which is used to activate the motor 170 when movement of the chairlift is desired. In the preferred embodiment, switch 280 consists of a two way switch which when closed to one direction permits movement of the chairlift in that direction. When moved to the other closed position, the switch moves the chairlift in the opposite direction. When moving downward on an inclined stairway or other base, the gear box 160 causes the chairlift to operate at a slower velocity than when moving upward in the preferred embodiment.

Normally seat assembly 106 is locked in a forward position, as shown in FIG. 5. The seat assembly 106 may be rotated selectively to positions facing 90° left or right of the front position. Rotation of seat assembly 106 is accomplished using a unique swivel arrangement. In the preferred embodiment, three slots 282 are provided in box cover 246. Slots 282 are provided at equidistant points 90° apart from the swivel tube 266. A swivel handle 284 is rotatably provided through bracket 262. A spring loaded lock pin 286 engages the center slot 282 in the front position. To move the seat assembly 106 to a left or right facing position, the operator lifts handle 284 to clear pin 286 from slot 282. The seat assembly 106 may then be rotated until pin 286 engages one of the other slots 282. Spring loading of the swivel handle 284 is done by conventional means and will not be discussed in detail.

A folding foot rest assembly is also provided. A foot rest support 288 is secured with several bolts 290 to the holes 220 of intermediate brace 214 on arm 204. Support 288 extends outwardly and downward from arm 204. A foot rest hanger bracket 292 is attached by a bolt 298 to the lower end of support 288. Welded to hanger bracket 292 is a torsion tube 294 in the preferred embodiment. A foot rest plate 296 is then welded to torsion tube 294. The foot rest plate 296 may selectively be raised, for example when the seat is in a locked and up position, with bolt 298 acting as the pivot point.

Variations, modifications and other applications will become apparent to those presently of ordinary skill in the art. Therefore, the above description of the preferred embodiment is to be interpreted as illustrative rather than limiting. The scope of the present invention is limited only by the scope of the claims which follow.

I claim:

1. An inclined lift device for transporting an individual passenger, said device comprising:

a) rail means comprising
   i) a generally elongated planar base surface;
   ii) first and second side guide surfaces perpendicular and attached to said base surface and extending upward therefrom;
   iii) first and second retaining surface perpendicular to and attached to said side guide surfaces and extending inward therefrom;
   iv) a linear gear rack having a plurality of teeth secured to one of said retaining surfaces said teeth being generally covered by a tape secured at each end of said rail;

b) carriage means comprising
   i) a housing ii) carriage wheel guide means comprising
first wheel guide means having a plurality of first stabilizer wheels attached rotatably to a plurality of first stabilizer wheel shafts which are mounted to said housing and are perpendicular to said base surface, said first stabilizer wheels engaging said side guide surfaces;
second wheel guide means having a plurality of axles mounted to said housing a plurality of second stabilizer wheels rotatably attached to said axles, said axles being perpendicular to said side guide surfaces and said second stabilizer wheels engaging said base and retaining surfaces;
iii) drive means comprising
gear box means mounted to said housing; a motor mounted to said gear box means; belt means operably connecting the output shaft of said motor to the input shaft of said gear box means;
a spur gear secured to the output shaft of said gear box means and operably engaging said gear rack;
means including said tape for generally enclosing the point at which said spur gear operatively engages said gear rack;
iv) electric control means mounted to said drive means by adjustable angle arm means, said control means comprising:
battery means;
battery recharging means connected to said battery means;
control circuit means including a switch for selectively operating said device in an up or down direction and for selectively operating said device at a desired speed, said control circuit means being connected to said battery means;
means connecting said control circuit means to said motor;
c. seat means comprising
i) a seat comprising
a backrest;
a seat cushion having a rear edge pivotably mounted to the bottom edge of said backrest; a seat cushion bracket rigidly mounted to the bottom edge of said backrest;
means connected to said seat cushion for selectively maintaining said cushion in an up position;
a pair of armrests rigidly fixed to said seat cushion, one of said armrests having said switch mounted thereto;
ii) means for selectively swivelling said seat means comprising;
a swivel mounting bracket fixed to the top of said carriage;
a swivel tube fixed to the bottom of said seat bracket;
wherein said swivel tube coaxially fits within said swivel mounting bracket and further wherein said swivel tube is free to rotate axially within said swivel mounting bracket;
means for selectively locking said seat in position.

2. A stairway chairlift device comprising:
a) a rail, said rail comprising a plurality of teeth between first and second ends of said rail, said teeth being generally covered by a tape secured at each end of said rail;
b) a carriage unit housing motor means operatively engaging said rail, wherein said carriage unit is selectively movable between first and second terminal positions on said rail and comprises means for generally enclosing the point at which said carriage unit operatively engages the teeth of said rail throughout movement of said carriage unit between the terminal positions on said rail; and
c) a collapsible seat assembly pivotably mounted to said carriage unit;
wherein said seat assembly is mounted to said carriage unit on an angularly adjustable mounting means to compensate for the angular orientation of said rail;
further wherein said motor means includes battery means for providing power to said device, said battery means being automatically self-recharging.

3. The device of claim 2 wherein said seat assembly comprises:
a) a seat bracket having a front edge and a rear edge, a backrest mounted to said rear edge:
b) a swivel tube fixed to the bottom of said seat bracket adjacent said front edge of said seat bracket;
c) a swivel mounting bracket fixed to the top of said carriage unit;
d) means for selectively locking said seat assembly in a preselected position;
wherein said swivel tube coaxially fits within said swivel mounting bracket and further wherein said swivel tube is free to rotate axially within said swivel mounting bracket.

4. The device of claim 3 wherein said battery means comprises:
a) a battery mounted in said carriage unit;
b) first rail contact means attached to the first end of said rail;
c) second rail contact means attached to the second end of said rail;
d) first carriage contact means attached to said carriage unit and connected to said battery;
e) second carriage contact means attached to said carriage unit and connected to said battery;
f) a battery recharger connected to said first and second rail contact means;
wherein when said carriage unit is in the first terminal position, said first rail contact means and said first carriage contact means are in electrical contact, thereby charging said battery;
further wherein when said carriage unit is in the second terminal position, said second rail contact means and said second carriage contact means are in electrical contact, thereby charging said battery.

5. A stairway chairlift device comprising:
1) a rail;
2) a carriage unit housing motor means operatively engaging said rail; and
3) a collapsible seat assembly pivotably mounted to said carriage means;
wherein said seat assembly is mounted to said carriage unit on an angularly adjustable mounting means to compensate for the angular orientation of the rail;
wherein said angularly adjustable mounting means comprises an arm which comprises:
a) a top flange section;

b) a lower tongue section; and c) an intermediate brace section connecting said flange and tongue sections;

wherein said flange section is rigidly secured to said seat assembly;

further wherein said tongue section includes an arcuate slot and a hole, said tongue section hole being located at the center of the circuit of which said slot is an arc;

further wherein said carriage unit comprises a plurality of holes, a first hole located adjacent said tongue section slot, said carriage unit further comprising first bolt means engaging said tongue section hole and said first carriage unit hole, said first bolt means selectively assisting in locking said arm in fixed relation to said carriage unit;

further wherein said carriage unit comprises second bolt means which engages said slot and said second carriage unit hole, said second bolt means selectively assisting in locking said arm in fixed relation to said carriage unit;

further wherein said motor means includes battery means for providing power to said device, said battery means being automatically self-recharging.

6. The device of claim 5 wherein said carriage unit further comprises a third hole adjacent said slot, said third carriage unit hole being arcuately spaced from said second carriage unit hole, further wherein said second bolt means may engage said slot and one of said second and third carriage unit holes, said second bolt means selectively assisting in locking said arm in fixed relation to said carriage unit.

7. The device of claim 2 wherein said enclosing means comprises:

a) a spur gear operatively connected to said motor means, said spur gear engaging said teeth to move said carriage unit along said rail;

b) a plurality of tape guides mounted to said carriage unit to guide said tape around said spur gear while maintaining the engagement of said teeth and said spur gear in a generally covered condition irrespective of whether said carriage unit is in motion on said rail.

8. The device of claim 3 wherein said seat assembly is lockable in a first position facing perpendicular to and away from said rail, a second position facing parallel to said rail and gennerally toward the first end of said rail, and a third position facing parallel to said rail and generally toward the second end of said rail;

further wherein said seat assembly locking means comprises a plurality of locking slots in the upper surface of said carriage unit, a handle extending beneath and clear of said seat assembly, and a spring-loaded locking pin attached to said handle, wherein said pin normally engages one of said locking slots unless said handle is raised, and further wherein said handle is raised, said seat assembly is free to rotate.

9. A chairlift device comprising:

a) a rail;

b) a carriage unit housing motor means operatively engaging said rail;

c) a seat assembly including a seat cushion intended to be in a horizontal position when said device is in use; and d) means for mounting said seat assembly to said carriage unit;

wherein said seat mounting means includes angular adjustment means to preselectively set said cushion in a horizontal position irrespective of the angular displacement of said rail;

further wherein said angular adjustment means comprises an angular adjustment arm having an arcuate adjustment slot adjacent said carriage unit, means for pivoting said arm relative to said carriage unit, means for locking said arm in a fixed angular relation to said carriage unit, and means for fixedly securing said arm to said seat assembly.

10. A chairlift device comprising:

a) a rail;

b) a carriage unit housing motor means operatively engaging said rail;

c) a seat assembly including a seat cushion intended to be in a horizontal position when said device is in use; and d) means for mounting said seat assembly to said carriage unit;

wherein said seat mounting means includes angular adjustment means to preselectively set said cushion in a horizontal position irrespective of the angular displacement of said rail;

further wherein said angular adjustment means comprises an arm which comprises:

a) a top flange section;

b) a lower tongue section; and c) an intermediate brace section connecting said flange and tongue sections;

wherein said flange section is rigidly secured to said seat assembly;

further wherein said tongue section includes an arcuate slot and hole, said hole being locate at the center of the circle of which said slot is and arc;

further wherein said carriage unit comprises a plurality of holes, a first tongue section hole located adjacent said tongue section hole and a second hole located adjacent said tongue section slot, said carriage unit further comprising first bolt means engaging said tongue section hole and said first carriage unit hole, said first bolt means selectively assisting in locking said arm in fixed relation to said carriage unit;

further wherein said carriage unit comprises second bolt means which engages said slot and said second carriage unit hole, said second bolt means selectively assisting in locking said arm in fixed relation to said carriage unit.

11. The device of claim 10 wherein said carriage unit further comprises a third hole adjacent said slot, said third carriage unit hole being arcuately spaced from said second carriage unit hole, further wherein said second bolt means may engage said slot and one of said second and third carriage unit holes, said second bolt means selectively assisting in locking said arm in fixed relation to said carriage unit.

12. A chairlift device comprising:

a) a rail, said rail comprising a plurality of teeth between the first and second ends of said rail, said teeth being generally covered by a tape secured at each end of said rail;

b) a carriage unit housing motor means operatively engaging said teeth, said carriage unit selectively movable between first and second terminal positions on said rail;

c) a seat assembly mounted to said carriage unit;

wherein said carriage unit comprises means for generally enclosing the point at which said carriage unit operatively engages the teeth of said rail throughout movement of said carriage unit between the terminal positions on said rail.

13. The device of claim 12 wherein said enclosing means comprises:

a) a spur gear operatively connected to said motor means, said spur gear engaging said teeth to move said carriage unit along said rail;

b) a plurality of tape guides mounted to said carriage unit to guide said tape around said spur gear while maintaining the engagement of said teeth and said spur gear in a generally covered condition irrespective of whether said carriage unit is in motion on said rail.

14. The device of claim 13 wherein said tape is nylon webbing.

15. A chairlift device comprising:

a) a rail;

b) a carriage unit housing motor means operatively engaging said rail, said carriage unit moving between first and second terminal positions on said rail;

c) a seat assembly mounted to said carriage unit, said seat assembly comprising:

i) a seat bracket having a front edge and a rear edge, a backrest being mounted at said rear edge of said bracket;

ii) a swivel tube fixed to the bottom of said seat bracket proximate to said front edge of said bracket;

iii) a swivel mounting bracket fixed to the top of said carriage unit and mounted to said carriage unit proximate to the front of said carriage unit;

iv) means for selectively locking said seat assembly in a preselected position;

wherein said swivel tube coaxially fits within said swivel mounting bracket and further wherein said swivel tube is free to rotate axially within said swivel mounting bracket.

16. The device of claim 15 wherein said seat assembly is lockable in a first position facing perpendicular to and away from said rail, a second position facing parallel to said rail and generally toward the first end of said rail, and a third position facing parallel to said rail and generally toward the second end of said rail.

17. The device of claim 16 wherein said seat assembly locking means comprises a plurality of locking slots in the upper surface of said carriage unit, a handle extending beneath and clear of said seat assembly, and a spring-loaded locking pin attached to said handle, wherein said pin normally engages one of said locking slots unless said handle is raised, and further wherein when said handle is raised, said seat assembly is free to rotate.

* * * * *